US006175973B1

(12) United States Patent
Hakamiun et al.

(10) Patent No.: US 6,175,973 B1
(45) Date of Patent: Jan. 23, 2001

(54) STAND ASSIST LIFT

(75) Inventors: Reza Hakamiun, Charleston; Douglas P. Genereux, North Charleston; Michael D. Falin, Summerville; Michael J. Mutka, North Charleston; Jason Conard Brooke, Mount Pleasant, all of SC (US)

(73) Assignee: Hill-Rom, Inc., Batesville, IN (US)

( * ) Notice: Under 35 U.S.C. 154(b), the term of this patent shall be extended for 0 days.

(21) Appl. No.: 09/364,095

(22) Filed: Jul. 30, 1999

Related U.S. Application Data

(60) Provisional application No. 60/094,995, filed on Jul. 31, 1998.

(51) Int. Cl.[7] ..... A61G 7/10

(52) U.S. Cl. ..... 5/89.1; 5/87.1; 5/86.1

(58) Field of Search ..... 5/81.1 R, 83.1, 5/86.1, 87.1, 89.1

(56) References Cited

U.S. PATENT DOCUMENTS

| | | | |
|---|---|---|---|
| D. 355,293 | | 2/1995 | Parker . |
| 3,189,345 | | 6/1965 | Simpson . |
| 3,252,704 | | 5/1966 | Wilson . |
| 3,374,493 | | 3/1968 | Herrera . |
| 3,394,933 | | 7/1968 | Benoit . |
| 3,397,883 | | 8/1968 | Kiehn . |
| 3,568,226 | | 3/1971 | Mater et al. . |
| 3,967,329 | | 7/1976 | Whitton, Jr. et al. . |
| 3,999,228 | | 12/1976 | Thomas . |
| 4,629,162 | | 12/1986 | Porche . |
| 4,656,679 | | 4/1987 | James . |
| 4,680,819 | | 7/1987 | James . |
| 4,703,523 | * | 11/1987 | James ..... 5/83.1 |
| 4,809,804 | | 3/1989 | Houston et al. . |
| 4,973,044 | | 11/1990 | Jones . |
| 5,309,584 | | 5/1994 | Parker . |
| 5,365,621 | | 11/1994 | Blain . |
| 5,502,851 | * | 4/1996 | Costello ..... 5/89.1 X |
| 5,530,976 | * | 7/1996 | Horcher ..... 5/89.1 |
| 5,619,762 | | 4/1997 | Mein . |
| 5,694,654 | | 12/1997 | Roy . |
| 5,711,044 | | 1/1998 | Newman et al. . |
| 5,729,843 | | 3/1998 | Manthey . |
| 5,742,957 | | 4/1998 | Vanzant . |
| 5,794,284 | | 8/1998 | Southwell, Jr. et al. . |
| 5,819,338 | | 10/1998 | Hession . |
| 5,878,450 | | 3/1999 | Bouhuijs . |
| 5,963,995 | * | 10/1999 | Glass ..... 5/89.1 X |

FOREIGN PATENT DOCUMENTS

| | | |
|---|---|---|
| 0 782 430 B1 | 6/1998 | (EP) . |
| WO 97/29725 | 8/1997 | (WO) . |

* cited by examiner

*Primary Examiner*—Michael F. Trettel
(74) *Attorney, Agent, or Firm*—Barnes & Thornburg

(57) ABSTRACT

An apparatus for assisting a person in achieving a standing position. The apparatus include a base, a frame extending upward from the base, a lifting arm pivotally coupled to the frame, a platform upon which a person can stand, and an actuator which is controlled to raise and lower the lifting arm. The apparatus also includes a sling assembly which is removably attachable to the lifting arm. The sling assembly includes matched sets of attachment loops for attaching the sling assembly to the lifting arm. The sling assembly also includes at least one caregiver handle on an outer back portion thereof.

55 Claims, 4 Drawing Sheets

STAND ASSIST LIFT

This application is based upon and claims the benefit of U.S. Provisional Application Serial No. 60/094,995, filed Jul. 31, 1998, now lapsed, the complete disclosure of which is hereby expressly incorporated by reference.

BACKGROUND AND SUMMARY OF THE INVENTION

The present invention relates to a stand-assist lift apparatus, and particularly to a stand-assist lift apparatus that can be used to support and assist a person during movement to a standing position.

It is known to provide stand-assist lifts to help people achieve a standing position. For example, prior art devices have bases that support the lift apparatus on the floor, frames that extend up from the bases, lifting arms that are coupled to the frames for movement from lowered positions to raised positions, and actuators that drive the lifting arms. A sling or belt is often provided that can be connected to the lifting arms and wrapped around the person for providing support as lifts assist in movement of the person to a standing position.

Stand-assist lifts are typically used in hospitals, and the bases thereof usually include wheels to facilitate convenient placement of the lifts, such as adjacent a bed. Lifts also typically include a foot support surface and a knee pad that help guide the person to the appropriate starting location on the lift prior to standing and help keep the person properly aligned relative to the lift during the process of standing. The sling is wrapped around the person and attached to the lift arm both to provide a lifting force to the person as well as to reduce the risk of the person falling during movement to the standing position. A stand-assist lift thus provides a useful mechanism for a person to achieve a standing position. Compared with manual assistance in standing by a care giver, such as a nurse, the person benefits from increased autonomy and safety. The nurse also benefits from reduced physical stress in assisting the person, who often is relatively much larger than the nurse. Stand assist lifts are often used to transport a partially-ambulatory patient between a bed and a toilet.

According to other features, characteristics, embodiments and alternatives of the present invention which will become apparent as the description thereof proceeds below, the present invention provides a stand-assist lift apparatus which includes a base, a frame extending upwardly from the base, a lifting arm assembly pivotally coupled to the frame for movement between a lowered position and a raised position, an actuator coupled to the lifting arm assembly for moving the lifting arm assembly between the lowered and raised positions, and a sling assembly configured to be removably coupled to the lifting arm assembly for supporting a person during movement of the lifting arm assembly between the lowered and raised positions. The sling assembly includes a body-supporting surface and a belt. The belt has a pair of laterally spaced apart belt straps extending from the body-supporting surface and a fastener for coupling the pair of laterally spaced apart belt straps together so that the body-supporting surface and pair of laterally spaced apart belt straps can encircle a person's body, the fastener permitting adjustment of the length of the belt around the person's body.

The present invention also provides a stand-assist lift apparatus which includes a base, a frame extending upwardly from the base, and a lifting arm assembly pivotally coupled to the frame for movement between a lowered position and a raised position. The lifting arm assembly includes at least one sling hook. The apparatus also includes an actuator coupled to the lifting arm assembly for moving the lifting arm assembly between the lowered and raised positions, and a sling assembly configured to support a person during movement of the lifting arm assembly between the lowered and raised positions. The sling assembly includes a body-supporting surface having laterally spaced apart sides, and two sets of attachment loops extending away from the laterally spaced apart sides. The two sets of attachment loops include a plurality of matched pairs of laterally opposed loops, each loop in a pair being substantially equidistant from the body-support surface, and each of the pairs of loops being color coded to distinguish that pair of loops from the remaining pairs of loops.

The present invention further provides a stand-assist lift apparatus which includes a base, a frame extending upwardly from the base, a lifting arm assembly pivotally coupled to the frame for movement between a lowered position and a raised position, an actuator coupled to the lifting arm assembly for moving the lifting arm assembly between the lowered and raised positions, and a sling assembly configured to be removably coupled to the lifting arm assembly for supporting a person during movement of the lifting arm assembly between the lowered and raised positions. The sling assembly includes a body-supporting surface, an outer surface opposite the body-supporting surface, and at least one handle coupled to the outer surface.

Additional features and advantages of the present invention will become apparent to those skilled in the art upon consideration of the following detailed description of illustrated embodiments exemplifying the best mode of carrying out the invention as presently perceived.

BRIEF DESCRIPTION OF DRAWINGS

The present invention will be described hereafter with reference to the attached drawings which are given as non-limiting examples only, in which.

DETAILED DESCRIPTION OF THE DRAWINGS

The present invention is directed to stand-assist lift apparatus that can be used to support a person during movement to a standing position. The apparatus includes a base, a frame extending upward from the base, a lifting arm pivotally coupled to the frame, a platform upon which a person can stand, and an actuator which can be operated to lift and lower the lifting arm. The apparatus also includes a sling assembly which is removably attachable to the lifting arm.

In use, the sling assembly is strapped around a person and attached to the lifting arm. While the person stands on the platform, the actuator causes the lifting arm to move upward, so that the sling assembly assists in lifting the person to a standing position. The apparatus can also include a knee pad which helps brace the person's lower legs during the assisted lifting procedure. The lifting arm can also be provided with handles which can be grasped by a person being lifted, and thereby used to steady the person during lifting.

The sling includes one or more matched sets of attachment loops that are configured to be attachable to sling hooks provided on the lifting arm. Different matched sets of the attachment loops can be color coded. The sling assembly can be provided with one or more handles on an outer back portion which can be grasped by a caregiver who is assisting in the lifting of a person.

Figure 1:
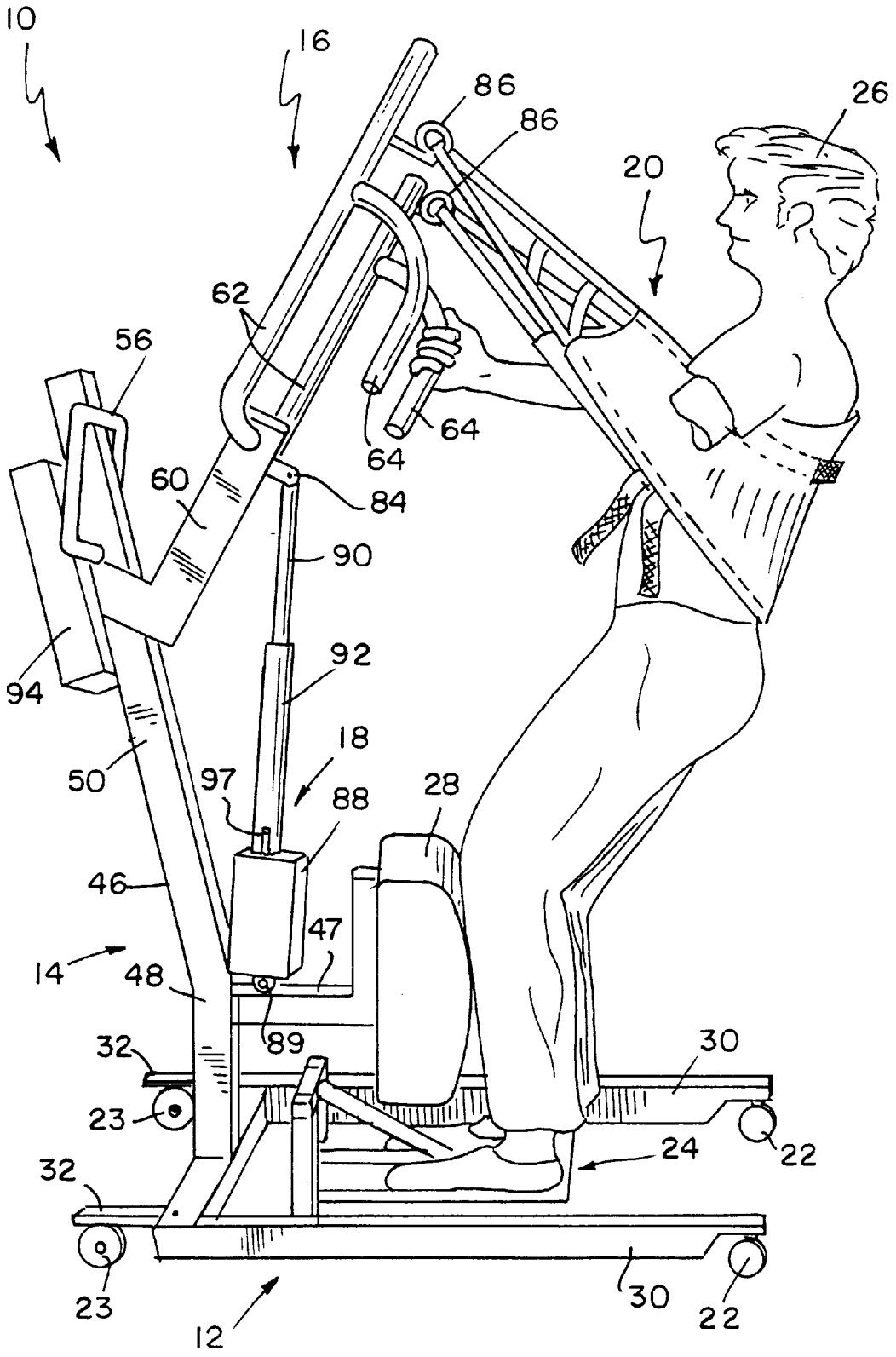
FIG. 1 is a perspective view showing a person using a stand-assist lift apparatus according to one embodiment of the present invention.

FIG. 1 is a perspective view showing a person using a stand-assist lift apparatus according to one embodiment of the present invention. The stand-assist lift is generally identified by reference numeral 10 and includes a base 12, a frame 14 that extends upwardly from base 12, a lifting arm assembly 16 pivotally coupled to frame 14, an actuator 18 coupled to frame 14 and to lifting arm assembly 16, and a sling assembly 20. Actuator 18 is used to drive lifting arm assembly 16 between a lowered position in which the lifting arm assembly 16 is within reach of a person sitting on a chair, bed or similar support and a raised position in which a person can assume a standing position. A raised position of the lifting arm assembly is depicted in FIG. 1 and a lowered position is depicted in FIG. 2.

Stand-assist lift 10 includes a plurality of casters 22 and 23 coupled to base 12 which facilitate moving stand-assist lift 10. Stand-assist lift 10 also includes a foot support 24 for locating a person 26 in the proper position to use stand-assist lift 10, and a knee pad 28 to assist a person 26 in maintaining an appropriate orientation while using stand-assist lift 10 to achieve a standing position.

Components of stand-assist lift 10, such as base 12, frame 14, and lifting arm assembly 16 illustratively are formed from conventional rectangular and/or tubular metal parts to provide for high structural strength while providing for relatively inexpensive manufacturing costs. Similarly, sling assembly 20 which is described in more detail below is formed using a standard fabric such as polyester to provide for high strength and low cost. Furthermore, a commercial, off-the-shelf component can be used for actuator 18, such as a model LA34 actuator (LINAK U.S. Inc., Louisville, Ky.) Stand-assist lift 10 thus provides a reliable, cost-efficient device suitable for use in applications where a person or individual may require varying degrees of assistance in achieving a standing position. Those skilled in the art will appreciate that other suitable well-known materials can be used to construct components of stand-assist lift 10 and other types of actuators can be provided to cause movement of the lifting arm assembly 16.

Figure 2:
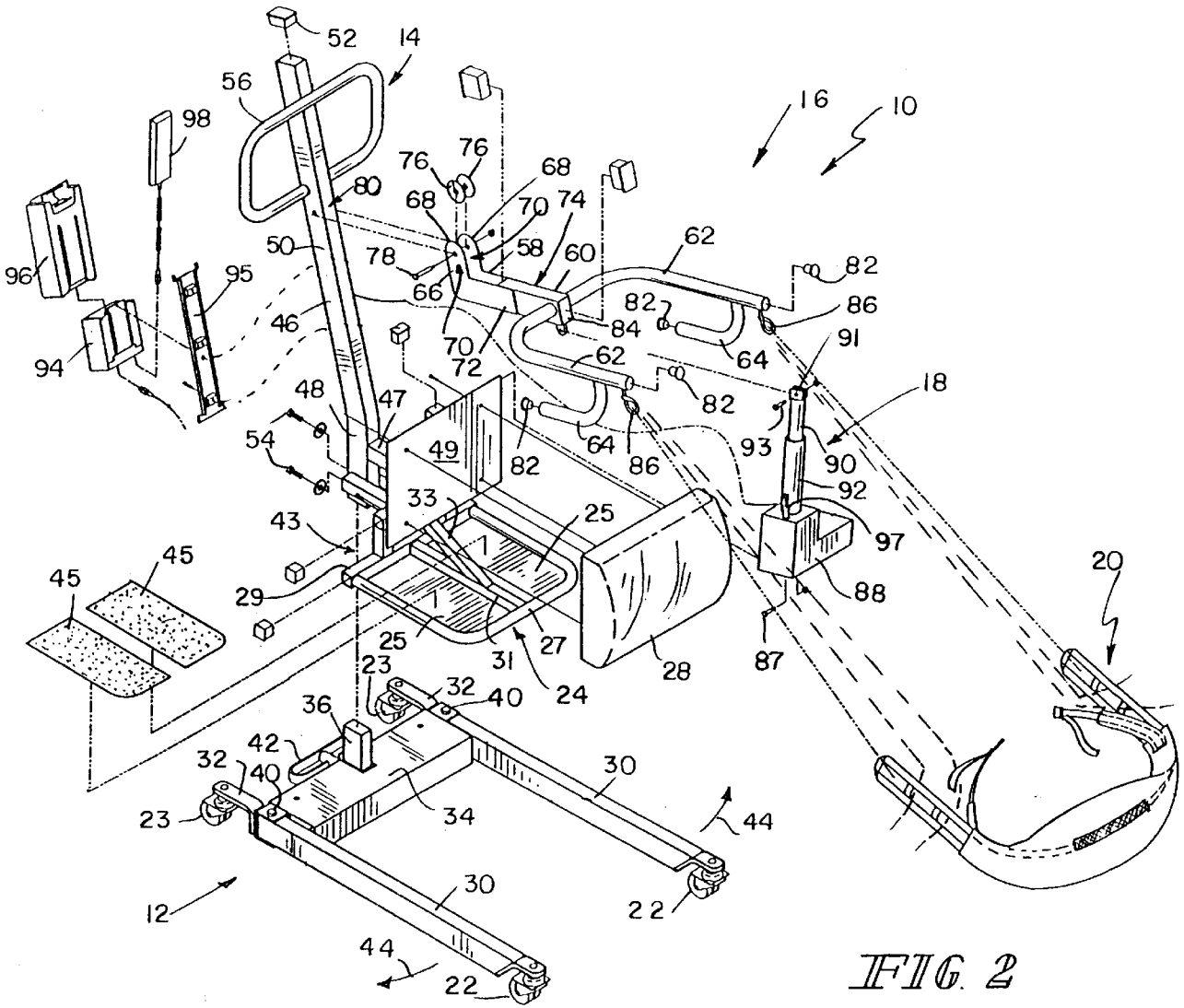
FIG. 2 is an exploded perspective view of the stand-assist lift apparatus of FIG. 1.

FIG. 2 is an exploded perspective view of the stand-assist lift apparatus of FIG. 1. In FIG. 2, base 12 is shown as including a pair of elongated front legs 30, a pair of rearwardly extending caster brackets 32, a cover or base housing 34 coupled to legs 30, and a frame mounting post 36 extending upwardly with respect to the cover or base housing 34. Two pairs of casters 22 and 23 are coupled to legs 30 and caster brackets 32, respectively. Casters 22 are illustratively dual wheel casters having rubber treads. Casters 23 are illustratively single wheel casters having rubber treads and wheel/swivel locks. Suitable casters 22 and 23 are available from Rhombus Casters (Westhampton, N.J.).

Legs 30 are coupled to housing 34 by pivots 40. A leg-spreading assembly (not shown) is provided beneath cover or base housing 34 and is coupled to pedal 42 and to legs 30. Pedal 42 is moved to spread legs 30 outwardly about pivots 40 as indicated by arrows 44. The spreading of legs 30 increases the stability of lift assembly 10. The leg-spreading assembly (not shown) can be any suitable mechanism that allows an operator to rotate or pivot legs 30, such as a tie-rod assembly, a screw-drive assembly, or a cam-actuated assembly. An electro-mechanical actuator (not shown) can also be used. Legs 30 alternatively can be rotated without using a pedal by applying force directly to legs 30. For manually rotatable legs, locking pins or braces can be provided to maintain desired positions of legs 30.

Frame 14 includes a column 46 having a vertical lower section 48 and a rearwardly slanted upper section 50. As mentioned above, tubular metal such as steel can be used for column 46. An end-cap 52 is provided to fit atop upper section 50. Lower section 48 of column 46 is configured to fit on mounting post 36 and can be coupled thereto by a pair of mechanical fasteners such as screws 54.

Frame 14 further includes a knee support bracket 47 coupled to lower section 48 of column 46. The knee support bracket 47 can be L-shaped as depicted or can have any convenient shape. The knee support bracket 47 supports a knee pad 28 which is positioned or adjustably positionable to brace a person's knees for assisted lifting as depicted in FIG. 1. The knee pad is coupled to support bracket 47 by a support plate 49.

A foot support 24 which includes a bracket assembly 43 is coupled to lower section 48 of column 46. As depicted, the bracket assembly 43 of the foot support 24 can be coupled on one or opposite sides of lower section 48 of column 46. Foot support 24 helps maintain placement of a person's feet with respect to knee pad 28 and lifting arm assembly 16 during assisted lifting as shown in FIG. 1. Foot support 24 can include a pair of non-skid pads 45 that are coupled to a platform 25 of foot support 24 to help enhance the traction for a person's feet. Foot support 24 includes a U-shaped perimeter frame member 27, a transverse frame member 29 coupled to ends of frame member 27, a central longitudinal frame member 31, and an inclined stabilizer member 33 extending between frame member 31 and bracket assembly 43. Transverse frame member 29 is coupled to basket assembly 43. Members 27, 29, 31 define left and right foot-receiving compartments.

Frame 14 also includes a handle 56 which can be formed as a rounded rectangle coupled to upper section 50 of column 46 to provide a caregiver with a convenient mechanism for moving stand-assist lift 10.

Lifting arm assembly 16 includes a mounting bracket 58, a center support arm 60 coupled to mounting bracket 58, a pair of lift arms 62 coupled to support arm 60, and a pair of handles 64 coupled to lift arms 62. Mounting bracket 58 includes an upper section 66 having spaced-apart flanges 68 each including a pin-receiving hole 70 and a lower section 72 having a support-receiving channel 74 which is configured to receive upper section 50 of column 46. Support arm 60 can be welded or mechanically fastened to mounting bracket 58 using screws or other conventional fasteners or support arm 60 and mounting bracket 58 can be formed as a single integral piece. Mounting bracket 58 is pivotally coupled to column 46 by a pin 78 that extends through holes 68 in flanges 66 and matching holes 80 in column upper section 50 of column 46 as shown in FIG. 2. Washers 76 can be provided on either side of upper section 50 of column 46 as depicted. It is to be understood that other pivoting connections can be used between mounting bracket 58 and column 46, such as any type of hinge mechanism.

Illustrative lift arms 62 and handles 64 are curved L-shaped components that are welded together as exemplified in FIGS. 1 and 2. End-caps 82 can be provided in the otherwise open ends of the lift arms 62 and handles 64. Lift arms 62 are coupled, e.g. welded, to support arm 60 which, in turn, is coupled, e.g. welded to mounting bracket 58 in channel 74. It is to be understood that any suitable mechanical fastener means can be used in lieu of welding to couple the lift arms 62, handles 64, and support arm 60. Handles 64 optionally include a covering such as a plastic, rubber or foam sheath (not shown) to provide an improved gripping surface.

Lifting arm assembly 16 further includes an actuator mount 84 that is welded or otherwise coupled to mounting bracket 58 for coupling to actuator 18 as discussed below. Lifting arm assembly 16 also includes a pair of sling hooks 86 on the ends of lift arms 62 for receiving sling assembly as depicted in FIG. 1 and discussed in more detail below. The sling hooks can be formed from a metal rod having a 270° twist. In alternative embodiments the sling hooks can comprise "S"- or "J"-shaped elements, or rings or eyelets upon which the sling assembly can be clipped. It is understood that any suitable structure or device that will catch or hold sling assembly loops can be used for sling hooks 86 and therefore, the term "hook" as used in the specification and in the claims is intended to cover all of these possible alternatives.

Actuator 18 is pivotally coupled to both the lifting arm assembly 16 and support bracket 47. Alternatively, actuator 18 could be pivotally coupled to both the lifting arm assembly 16 and column 46 by suitable mounting brackets. As discussed above, actuator 18 is used to drive lifting arm assembly 16 between a lowered position in which the lifting arm assembly is within reach of a person sitting on a chair, bed or similar support and a raised position in which a person can assume a standing position. An exemplary actuator useful for purposes of the present invention is a LINAK LA34 electro-mechanical actuator (LINAK U.S. Inc., Louisville, Ky.) having a DC motor 88 and an extendable cylinder 90 that extends and retracts within an outer cylinder 92 as commanded by a controller 94. Extendable cylinder 90 includes a distal bracket 91 that is pivotally coupled to actuator mount 84 by a pin 93. Motor 88 includes a bottom bracket 89, shown in FIG. 1, that is pivotally coupled by a pin 87, shown in FIG. 2, to knee support bracket 47. It is to be understood that the present invention is not limited to the use of a LINAK LA 34 actuator, and that similar electro-mechanical actuators or manually operable mechanisms, winches, rack and pinion assemblies, etc., can be used.

Actuator 18 is controlled by controller 94. According to one exemplary embodiment, a battery-operated model CBJ1 controller (LINAK U.S. inc., Louisville, Ky.) is used to control actuator 18. In further embodiments of the present invention, controller 94 can also be used to control an optional leg-spreader actuator (not shown). Battery 96 provides power for controller 94 and motor 88. Battery 96 may be removed from lift 10 for recharging by a separate battery charger (not shown). Controller 94 and battery 96 are coupled to upper section 50 of column 46 by a mounting plate 95 shown in FIG. 2. Controller 94 also includes a hand set 98 coupled to controller 94 by a flexible coil. Hand set 98 includes a magnet to allow for convenient, temporarily coupling of hand set 98 to any ferrous metal component of stand-assist lift 10. Alternatively, hand set 98 could be removable coupled to stand assist lift 10 by means of a cradle, Velcro hook and loop fastener; or similar structure.

Controller 94 includes an electric emergency lowering capability that allows lowering of lifting arm assembly 16 by a caregiver in an emergency. According to one embodiment, the emergency lowering feature can be activated by inserting a pen or other suitably sized object into an aperture in a face plate (not shown) of controller 94. This causes a connection directly from the battery to the actuator and bypasses controller circuitry in case of a controller circuit component failure. Controller 94 also provides a mechanical quick release ring or pin 97 to provide for fast, stepless retraction of extendable cylinder 90. The quick release can be activated by pulling release ring or pin 97, which causes a wrap spring inside outer cylinder 92 to expand its diameter and allows a clutch housing to rotate so that extendable cylinder 90 can retract. An adjuster (not shown) can be optionally provided for switching between a fast speed and a slower speed of retraction for extendable cylinder 90.

Figure 3:
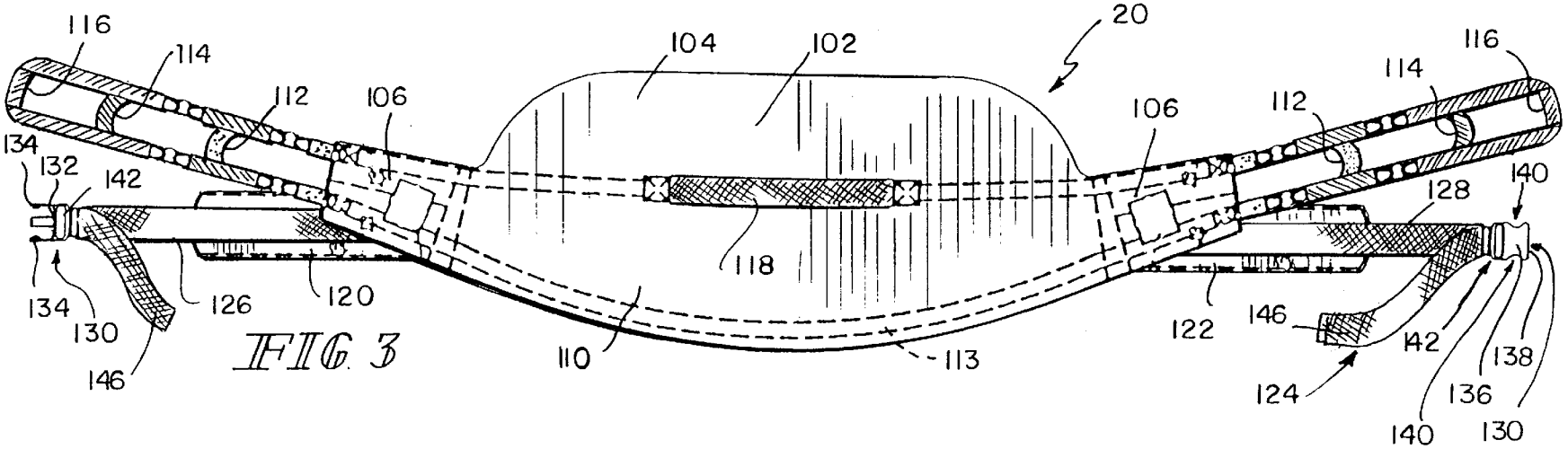
FIG. 3 is a back view of the sling assembly of FIG. 1.

FIG. 3 is a back view of the sling assembly of FIG. 1. Sling assembly 20 includes a main sling back-support piece 102 having a back-supporting portion 104 and a pair of side sections 106. Sling assembly 20 is configured to wrap around a person and be coupled to lifting arm assembly 16 and thereby provide support during movement from the lowered position to the raised position. Back-support piece 102 can be a single thick layer of material or illustratively is formed from two layers of heavy duty polyester with foam padding material in between. Back-supporting section 104 includes an inner, back-supporting surface 108 (FIG. 4) and an outer surface 110, and is formed relatively wider than side sections 106 to increase the surface area engaging a person and provide extra support during lift-assist operation. It to be understood that back-support piece 102 can be formed from any flexible material, such as cotton, canvas, nylon, etc., that any number of layers can be used, and that other padding materials or no padding material can be used between layers.

Figure 4:
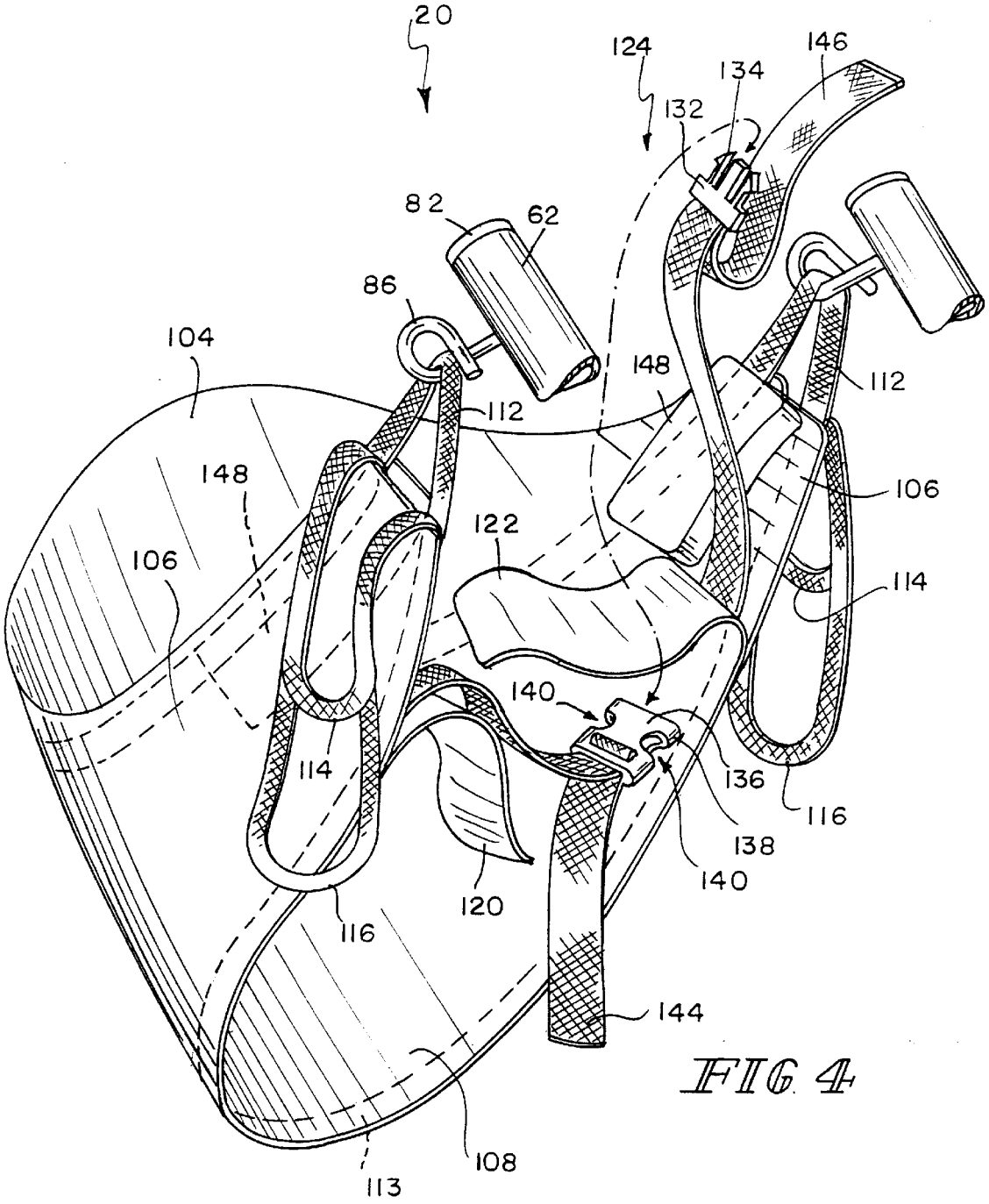
FIG. 4 is an enlarged perspective view of the sling assembly of FIG. 1.

FIG. 4 is an enlarged perspective view of the sling assembly of FIG. 3. Sling assembly 20 further includes two pairs of three attachment loops 112, 114 and 116 extending from side sections 106 as best shown in FIGS. 3 and 4. Attachment loops 112, 114 and 116 are configured to be retained by sling hooks 86 as shown in FIGS. 1 and 4. The use of multiple loops allows for adjusting sling assembly 20 to accommodate persons of various sizes.

Both outer attachment loops 116 are formed from a single looped strap 113 that extends across sling back-support piece 102 between back-supporting surface 108 and outer surface 110. Using a continuous loop across back-support piece 102 increases the strength of sling assembly 20. Each inner and middle attachment loop 112 and 114 is illustratively formed from separate fabric straps sewn onto strap 113. Although three attachment loops are depicted, it is to be understood that any number of attachment loops can be provided and that they can be coupled to back-support piece 102 in any suitable manner.

Proper use of sling assembly 20 typically involves using matched pairs of attachment loops 112, 114 and 116. In order to facilitate this, each of the pairs of loops 112, 114 and 116 can be provided with a unique color coding. Illustratively, inner loops 112 can be formed from green fabric, middle loops 114 can be formed from red fabric, and strap 113 can be formed from black fabric so that outer loops 116 are black. Thus, in order to couple sling assembly 20 to lifting arm assembly 16, the person or caregiver can use the color coding to ensure that matched pairs of loops are hooked onto the sling hooks 86. It is understood that other color coding schemes can be used, such as color coding only a portion of a loop, or using multiple colors, or using visual indicia other than color.

Sling assembly 20 further includes a pair of flaps 120 and 122, a belt 124 having a pair of belt straps 126 and 128, and a belt fastener 130. Similar to back support piece 102, flaps 120 and 122 can be formed from a single thick layer of material or from two fabric layers sewn together with padding material therebetween. Belt 124 is configured to wrap around flaps 120 and 122 to firmly secure a person within sling assembly 20. Flaps 120 and 122 insulate the person from contact with belt straps 126, 128 and belt fastener 130.

Belt fastener 130 is illustratively a two-piece assembly having a male end 132 with barbed tabs 134 and a female end 136 having a socket 138 with barb-receiving apertures 140. Each belt fastener end 132 and 136 includes a belt strap slot 142 to allow respective belt end portions 144 and 146 to extend therethrough and provide first and second belt pulls. Providing two belt pulls on opposite sides of fastener 130 allows fastener 130 to remain centered during tightening of belt 124. Although a fastener design that provides belt pulls akin to designs commonly used on items such as backpacks and child seats is used for fastener 130, it is to be understood that any suitable belt fastener can be used. Furthermore, although belt end portions 144 and 146 are used to provide a pair of belt pulls for allowing easy adjustment of belt 120 around a person's body, other belt pulls can be used.

In another embodiment of the present invention, a Velcro hook and loop fastener, or other type of hook and loop fastener, is used on the belt straps 126 and 128. A hook portion of the Velcro hook and loop fastener is located on one of the belt straps 126, 128 and the loop portion of the Velcro hook and loop fastener is located on the other of the belt straps 128, 126. The Velcro hook and loop fastener permits the length of the belt strap to be adjusted around the person's body.

Sling assembly 20 also includes a pair of side pads 148 which are best shown in FIG. 4. Side pads 148 are sandwiched between the two fabric layers of side sections 106, or alternatively, are coupled to back support piece side sections 106 to provide extra cushioning on a person's side and arm pits. Side pads 148 can be attached as shown in FIG. 4 or sewn into the fabric of side sections 106. Side pads 148 provide comfort and for extra support under a person's arm pits in case a person should fall while retained by sling assembly 20 during operation of stand-assist lift 10.

Figure 5:
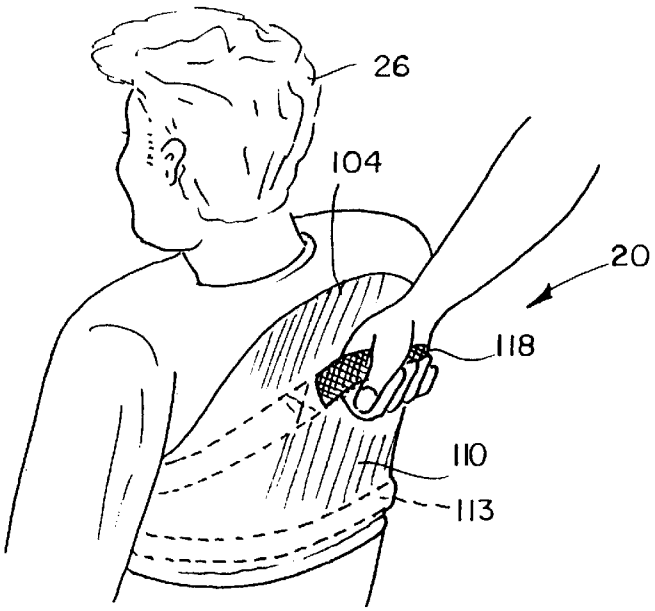
FIG. 5 is a perspective view showing a caregiver using the handle on the sling assembly of FIG. 1 to assist a person.

FIG. 5 is a perspective view showing a caregiver using the handle on the sling assembly of FIG. 1 to assist a person. Sling assembly 20 includes a caregiver handle 118 attached to back-support piece outer surface 110. Handle 118 is illustratively formed by sewing a fabric strap onto surface 110 above strap 113 so that when a caregiver assists a person as shown in FIG. 5, the force on handle 118 is transmitted substantially directly to lifting arm assembly 16, without causing undue stress on back-support piece 102. It is to be understood that other handle configurations can be used, such as a pair of handles 108 spaced apart either in a vertical or horizontal direction.

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention as described by the claims which follow.

What is claimed is:

1. A stand-assist lift apparatus comprising:

a base;

a frame extending upwardly from the base;

a lifting arm assembly pivotally coupled to the frame for movement between a lowered position and a raised position;

an actuator coupled to the lifting arm assembly for moving the lifting arm assembly between the lowered and raised positions; and a sling assembly configured to be removably coupled to the lifting arm assembly for supporting a person between the lower and upper back regions during movement of the lifting arm assembly between the lowered and raised positions, the sling assembly including a body-supporting surface and a belt, the belt having a pair of laterally spaced apart belt straps extending from the body-supporting surface and a fastener for coupling the pair of laterally spaced apart belt straps together so that the body-supporting surface and pair of laterally spaced apart belt straps can encircle a person's body, the fastener permitting adjustment of the length of the belt around the person's body.

2. The stand-assist lift apparatus of claim 1, wherein the lifting arm assembly includes a pair of hand grips.

3. The stand-assist lift apparatus of claim 1, wherein the lifting arm assembly includes a pair of sling hooks and the sling assembly includes at least two attachment loops configured to engage the pair of sling hooks, the at least two attachment loops extending away from opposite sides of the body-supporting surface.

4. The stand-assist lift apparatus of claim 1, wherein the actuator includes a release mechanism for disabling the actuator from raising the lifting arm assembly and allowing the actuator to move to the lowered position.

5. The stand-assist lift apparatus of claim 4, wherein the release mechanism is movable between an engaged position for enabling the actuator to move the lifting arm assembly and a disengaged position for disabling the actuator from raising the lifting arm assembly and allowing the actuator to move to the lowered position.

6. The stand-assist lift apparatus of claim 1, further comprising a foot platform coupled to one of the base and frame.

7. The stand-assist lift apparatus of claim 1, further comprising a knee pad coupled to the frame below the actuator.

8. The stand-assist lift apparatus of claim 1, wherein at least one of the belt straps include an end portion extending through the fastener to provide a belt pull for adjustment of the length of the belt around the person's body.

9. The stand-assist lift apparatus of claim 1, wherein the fastener is a hook and loop fastener having first and second fastener portions coupled to the pair of belt straps.

10. A stand-assist lift apparatus comprising:

a base;

a frame extending upwardly from the base;

a lifting arm assembly pivotally coupled to the frame for movement between a lowered position and a raised position;

an actuator coupled to the lifting arm assembly for moving the lifting arm assembly between the lowered and raised positions; and a sling assembly configured to be removably coupled to the lifting arm assembly for supporting a person during movement of the lifting arm assembly between the lowered and raised positions, the sling assembly including a body-supporting surface and a belt, the belt having a pair of laterally spaced apart belt straps extending from the body-supporting surface and a fastener for coupling the pair of laterally spaced apart belt straps together so that the body-supporting surface and pair of laterally spaced apart belt straps can encircle a person's body, the fastener permitting adjustment of the length of the belt around the person's body, wherein the lifting arm assembly includes a pair of sling hooks and the sling assembly includes two sets of attachment loops configured to engage a pair of sling hooks, the two sets of attachment loops extending away from opposite sides of the body-supporting surface.

11. The stand-assist lift apparatus of claim 10, wherein the two set of attachment loops provide a plurality of matched pairs of laterally opposed loops, each loop in a pair being substantially equidistant from the body-support surface, and each of the pairs of loops being color coded to distinguish that pair of loops from the remaining pairs of loops.

12. A stand-assist lift apparatus comprising:

a base;

a frame extending upwardly from the base;

a lifting arm assembly pivotally coupled to the frame for movement between a lowered position and a raised position;

an actuator coupled to the lifting arm assembly for moving the lifting arm assembly between the lowered and raised positions; and a sling assembly configured to be removably coupled to the lifting arm assembly for supporting a person during movement of the lifting arm assembly between the lowered and raised positions, the sling assembly including a body-supporting surface and a belt, the belt having a pair of laterally spaced apart belt straps extending from the body-supporting surface and a fastener for coupling the pair of laterally spaced apart belt straps together so that the body-supporting surface and pair of laterally spaced apart belt straps can encircle a person's body, the fastener permitting adjustment of the length of the belt around the person's body, wherein the sling assembly further includes a pair of flaps that extend away from the opposite sides of the body-supporting surface, the pair of flaps being configured to lie radially inward of the pair of belt straps when the belt straps encircle a person's body.

13. The stand-assist lift apparatus of claim 12, wherein the pair of flaps are padded.

14. The stand-assist lift apparatus of claim 12, wherein the pair of flaps are substantially the same.

15. A stand-assist lift apparatus comprising:

a base;

a frame extending upwardly from the base;

a lifting arm assembly pivotally coupled to the frame for movement between a lowered position and a raised position;

an actuator coupled to the lifting arm assembly for moving the lifting arm assembly between the lowered and raised positions; and a sling assembly configured to be removably coupled to the lifting arm assembly for supporting a person during movement of the lifting arm assembly between the lowered and raised positions, the sling assembly including a body-supporting surface and a belt, the belt having a pair of laterally spaced apart belt straps extending from the body-supporting surface and a fastener for coupling the pair of laterally spaced apart belt straps together so that the body-supporting surface and pair of laterally spaced apart belt straps can encircle a person's body, the fastener permitting adjustment of the length of the belt around the person's body, wherein the sling assembly further includes a pair of laterally spaced apart side pads adjacent the body-supporting surface.

16. A stand-assist lift apparatus comprising:

a base;

a frame extending upwardly from the base;

a lifting arm assembly pivotally coupled to the frame for movement between a lowered position and a raised position;

an actuator coupled to the lifting arm assembly for moving the lifting arm assembly between the lowered and raised positions; and a sling assembly configured to be removably coupled to the lifting arm assembly for supporting a person during movement of the lifting arm assembly between the lowered and raised positions, the sling assembly including a body-supporting surface and a belt, the belt having a pair of laterally spaced apart belt straps extending from the body-supporting surface and a fastener for coupling the pair of laterally spaced apart belt straps together so that the body-supporting surface and pair of laterally spaced apart belt straps can encircle a person's body, the fastener permitting adjustment of the length of the belt around the person's body, wherein the body-supporting surface includes laterally spaced apart side portions and a central portion between the laterally spaced apart side portions, the laterally spaced apart side portions having width which is less than a width of the central portion.

17. The stand-assist lift apparatus of claim 16, wherein the width of the central portion tapers symmetrically near the laterally spaced apart side portions.

18. A stand-assist lift apparatus comprising:

a base;

a frame extending upwardly from the base;

a lifting arm assembly pivotally coupled to the frame for movement between a lowered position and a raised position;

an actuator coupled to the lifting arm assembly for moving the lifting arm assembly between the lowered and raised positions; and a sling assembly configured to be removably coupled to the lifting arm assembly for supporting a person during movement of the lifting arm assembly between the lowered and raised positions, the sling assembly including a body-supporting surface and a belt, the belt having a pair of laterally spaced apart belt straps extending from the body-supporting surface and a fastener for coupling the pair of laterally spaced apart belt straps together so that the body-supporting surface and pair of laterally spaced apart belt straps can encircle a person's body, the fastener permitting adjustment of the length of the belt around the person's body, wherein the sling assembly includes an outer surface opposite the body-supporting surface and at least one handle coupled to the outer surface.

19. A stand-assist lift apparatus comprising:

a base;

a frame extending upwardly from the base;

a lifting arm assembly pivotally coupled to the frame for movement between a lowered position and a raised position;

an actuator coupled to the lifting arm assembly for moving the lifting arm assembly between the lowered and raised positions; and a sling assembly configured to be removably coupled to the lifting arm assembly for supporting a person during movement of the lifting arm assembly between the lowered and raised positions, the sling assembly including a body-supporting surface and a belt, the belt having a pair of laterally spaced apart belt straps extending from the body-supporting surface and a fastener for coupling the pair of laterally spaced apart belt straps together so that the body-supporting surface and pair of laterally spaced apart belt straps can encircle a person's body the fastener permitting adjustment of the length of the belt around the person's body;

the actuator including a release mechanism for disabling the actuator from raising the lifting arm assembly and allowing the actuator to move to the lowered position, the release mechanism including a push button for disabling the actuator from raising the lifting arm assembly and allowing the actuator to move to the lowered position.

20. A stand-assist lift apparatus comprising:

a base;

a frame extending upwardly from the base;

a lifting arm assembly pivotally coupled to the frame for movement between a lowered position and a raised position, the lifting arm assembly including at least one sling hook;

an actuator coupled to the lifting arm assembly for moving the lifting arm assembly between the lowered and raised positions; and a sling assembly configured to support a person during movement of the lifting arm assembly between the lowered and raised positions, the sling assembly including a body-supporting surface having laterally spaced apart sides, two sets of attachment loops extending away from the laterally spaced apart sides, the two sets of attachment loops comprising a plurality of matched pairs of laterally opposed loops, each loop in a pair being substantially equidistant from the body-support surface, and each of the pairs of loops being color coded to distinguish that pair of loops from the remaining pairs of loops.

21. The stand-assist lift apparatus of claim 20, wherein the sling assembly further includes a belt, the belt having a pair of laterally spaced apart belt straps extending from the body-supporting surface and a fastener to couple the pair of laterally spaced apart belt straps together so that the body-supporting surface and pair of laterally spaced apart belt straps can encircle a person's body.

22. The stand-assist lift apparatus of claim 21, wherein at least one of the laterally spaced apart belt straps includes an end portion which extends through the fastener to provide belt pull that can be used for adjustment of the belt around the person's body.

23. The stand-assist lift apparatus of claim 22, wherein both of the laterally spaced apart belt straps include end portions which extend through the fastener to provide belt pulls that can be used for adjustment of the belt around the person's body.

24. The stand-assist apparatus of claim 20, wherein the lifting arm assembly includes a pair of hand grips.

25. The stand-assist lift apparatus of claim 22, wherein the sling assembly further includes a pair of flaps that extend away from opposite sides of the body-supporting surface, the pair of flaps being configured to lie radially inward of the pair of belt straps when the belt encircle a person's body.

26. The stand-assist lift apparatus of claim 25, wherein the pair of flaps are padded.

27. The stand-assist lift apparatus of claim 25, wherein the pair of flaps are substantially the same size.

28. The stand-assist lift apparatus of claim 20, wherein the sling assembly further includes a pair of laterally spaced apart side pads adjacent the body-supporting surface.

29. The stand-assist lift apparatus of claim 20, wherein the body-supporting surface includes a central portion between opposed side portions, the opposed side portions having a width which is less than a width of the central portion.

30. The stand-assist lift apparatus of claim 29, wherein the width of the central portion tapers symmetrically near the laterally spaced apart side portions.

31. The stand-assist lift apparatus of claim 20, wherein the sling assembly includes an outer surface opposite the body-supporting surface and at least one handle coupled to the outer surface.

32. The stand-assist lift apparatus of claim 20, wherein the actuator includes a release mechanism for disabling the actuator from moving the lifting arm assembly and allowing the actuator to move to the lowered position.

33. The stand-assist lift apparatus of claim 32, wherein the release mechanism is movable between an engaged position for enabling the actuator to move the lifting arm assembly and a disengaged position for disabling the actuator from raising the lifting arm assembly and allowing the actuator to move to the lowered position.

34. The stand-assist lift apparatus of claim 32, wherein the release mechanism includes a push button for disabling the actuator from raising the lifting arm assembly and allowing the actuator to move to the lowered position.

35. The stand-assist lift apparatus of claim 20, further comprising a foot platform coupled to one of the base and frame.

36. The stand-assist lift apparatus of claim 20, further comprising a knee pad coupled to the frame below the actuator.

37. A stand-assist lift apparatus comprising:

a base;

a frame extending upwardly from the base;

a lifting arm assembly pivotally coupled to the frame for movement between a lowered position and a raised position;

an actuator coupled to the lifting arm assembly for moving the lifting arm assembly between the lowered and raised positions; and a sling assembly configured to removably coupled to the lifting arm assembly for supporting a person during movement of the lifting arm assembly between the lowered and raised positions, the sling assembly including a body-supporting surface, an outer surface opposite the body-supporting surface, and at least one handle coupled to the outer surface, the body-supporting surface being adapted to support the person between the lower back and the upper back.

38. The stand-assist lift apparatus of claim 37, wherein the lifting arm assembly includes a pair of sling hooks and the sling assembly includes a pair of attachment loops configured to engage the pair of sling hooks, each of the pair of attachment loops extending away from opposite side of the body-supporting surface.

39. The stand-assist lift apparatus of claim 37, wherein the sling assembly further includes a belt, the belt having laterally spaced apart belt straps extending from the body-supporting surface and a fastener for coupling the laterally spaced apart belt straps together so that the body-supporting surface and laterally spaced apart belt straps can encircle a person's body.

40. The stand-assist lift apparatus of claim 39, wherein at least one of the laterally spaced apart belt straps includes an end portion extending through the fastener for providing a belt pull that can be used for adjustment of the belt around the person's body.

41. The stand-assist lift apparatus of claim 40, wherein both of the laterally spaced apart belt straps include end portions which extend through the fastener for providing belt pulls that can be used for adjustment of the belt around the person's body.

42. The stand-assist lift apparatus of claim 37, wherein the lifting arm assembly includes a pair of hand grips.

43. The stand-assist lift apparatus of claim 37, wherein the actuator includes a release mechanism for disabling the actuator from raising the lifting arm assembly and allowing the actuator to move to the lowered position.

44. The stand-assist lift apparatus of claim 37, further comprising a foot platform coupled to one of the base and frame.

45. The stand-assist lift apparatus of claim 37, further comprising a knee pad coupled to the frame below the actuator.

46. A stand-assist lift apparatus comprising:

a base;

a frame extending upwardly from the base;

a lifting arm assembly pivotally coupled to the frame for movement between a lowered position and a raised position;

an actuator coupled to the lifting arm assembly for moving the lifting arm assembly between the lowered and raised positions; and a sling assembly configured to be removably coupled to the lifting arm assembly for supporting a person during movement of the lifting arm assembly between the lowered and raised positions the sling assembly including a body-supporting surface, an outer surface opposite the body-supporting surface, and at least one handle coupled to the outer surface, wherein the lifting arm assembly includes a pair of sling hooks and the sling assembly includes two sets of attachment loops configured to engage the pair of sling hooks, the two sets of attachment loops extending away from opposite sides of the body-supporting surface.

47. The stand-assist lift apparatus of claim 46, wherein the two sets of attachment loops provide a plurality of matched pairs of laterally opposed loops, each loop in a pair being substantially equidistant from the body-support surface, and each of the pairs of loops being color coded to distinguish that pair of loops from the remaining pairs of loops.

48. A stand-assist lift apparatus comprising:

a base;

a frame extending upwardly from the base;

a lifting arm assembly pivotally coupled to the frame for movement between a lowered position and a raised position;

an actuator coupled to the lifting arm assembly for moving the lifting arm assembly between the lowered and raised positions; and a sling assembly configured to be removably coupled to the lifting arm assembly for supporting a person during movement of the lifting arm assembly between the lowered and raised positions, the sling assembly including a body-supporting surface, an outer surface opposite the body-supporting surface, and at least one handle coupled to the outer surface, wherein the sling assembly further includes a belt having laterally spaced apart belt straps extending from the body-supporting surface and a fastener for coupling the laterally spaced apart belt straps together so that the body-supporting surface and laterally spaced apart belt straps can encircle a person's body, and a pair of flaps which extend away from opposite sides of the body-supporting surface, each of the pair of flaps being configured to lie radially inward of the laterally spaced apart belt straps when the laterally spaced apart belt straps encircle a person's body.

49. The stand-assist lift apparatus of claim 48, wherein the flaps are padded.

50. The stand-assist lift apparatus of claim 48, wherein the flaps are substantially the same size.

51. A stand-assist lift apparatus comprising:

a base;

a frame extending upwardly from the base;

a lifting arm assembly pivotally coupled to the frame for movement between a lowered position and a raised position;

an actuator coupled to the lifting arm assembly for moving the lifting arm assembly between the lowered and raised positions; and a sling assembly configured to be removably coupled to the lifting arm assembly for supporting a person during movement of the lifting arm assembly between the lowered and raised positions, the sling assembly including a body-supporting surface, an outer surface opposite the body-supporting surface, and at least one handle couple to the outer surface, wherein the sling assembly further includes laterally spaced apart side pads adjacent the body-supporting surface.

52. A stand-assist lift apparatus comprising:

a base;

a frame extending upwardly from the base;

a lifting arm assembly pivotally coupled to the frame for movement between a lowered position and a raised position;

an actuator coupled to the lifting arm assembly for moving the lifting arm assembly between the lowered and raised positions; and a sling assembly configured to be removably coupled to the lifting arm assembly for supporting a person during movement of the lifting arm assembly between the lowered and raised positions, the sling assembly including a body-supporting surface, an outer surface opposite the body-supporting surface, and at least one handle coupled to the outer surface, wherein the body supporting surface includes laterally spaced apart side portions and a central portion between the laterally spaced apart side portions, the laterally spaced part side portions having a width which is less than a width of the central portion.

53. The stand-assist lift apparatus of claim 52, wherein the width of the central portion tapers symmetrically near the laterally spaced apart side portions.

54. A stand-assist lift apparatus comprising:

a base;

a frame extending upwardly from the base;

a lifting arm assembly pivotally coupled to the frame for movement between a lowered position and a raised position;

an actuator coupled to the lifting arm assembly for moving the lifting arm assembly between the lowered and raised positions; and a sling assembly configured to be removably coupled to the lifting arm assembly for supporting a person during movement of the lifting arm assembly between the lowered and raised positions, the sling assembly including a body-supporting surface, an outer surface opposite the body-supporting surface, and at least one handle coupled to the outer surface, wherein the actuator includes a release mechanisms for disabling the actuator from raising the lifting arm assembly and allowing the actuator to move the lowered position, and the release mechanism comprises a pull-pin that is movable between an engaged position for enabling the actuator to move the lifting arm assembly and a disengaged position for disabling the actuator from raising the lifting arm assembly and allowing the actuator to move to the lowered position.

55. A stand-assist lift apparatus comprising:

a base;

a frame extending upwardly from the base;

a lifting arm assembly pivotally coupled to the frame for movement between a lowered position and a raised position;

an actuator coupled to the lifting arm assembly for moving the lifting arm assembly between the lowered and raised positions; and a sling assembly configured to be removably coupled to the lifting arm assembly for supporting a person during movement of the lifting arm assembly between the lowered and raised positions, the sling assembly including a body-supporting surface, an outer surface opposite the body-supporting surface, and at least one handle coupled to the outer surface, wherein the actuator includes a release mechanism for disabling the actuator from raising the lifting arm assembly and allowing the actuator to move to the lowered position, and the release includes a push button for disabling the actuator from raising the lifting arm assembly and allowing the actuator to move to the lowered position.

* * * * *